US009718644B2

(12) United States Patent
Kyue et al.

(10) Patent No.: US 9,718,644 B2
(45) Date of Patent: Aug. 1, 2017

(54) ELEVATOR CAR

(71) Applicant: Mitsubishi Electric Corporation, Chiyoda-ku (JP)

(72) Inventors: Kazuhiro Kyue, Chiyoda-ku (JP); Takeshi Matsumoto, Chiyoda-ku (JP); Seiji Watanabe, Chiyoda-ku (JP)

(73) Assignee: MITSUBISHI ELECTRIC CORPORATION, Chiyoda-ku (JP)

( * ) Notice: Subject to any disclaimer, the term of this patent is extended or adjusted under 35 U.S.C. 154(b) by 92 days.

(21) Appl. No.: 14/782,663

(22) PCT Filed: Apr. 26, 2013

(86) PCT No.: PCT/JP2013/062389
§ 371 (c)(1),
(2) Date: Oct. 6, 2015

(87) PCT Pub. No.: WO2014/174668
PCT Pub. Date: Oct. 30, 2014

(65) Prior Publication Data

US 2016/0068370 A1 Mar. 10, 2016

(51) Int. Cl.
*B66B 11/02* (2006.01)

(52) U.S. Cl.
CPC ..... *B66B 11/0273* (2013.01); *B66B 11/0206* (2013.01); *B66B 11/0226* (2013.01)

(58) Field of Classification Search
CPC ..... B66B 11/0206; B66B 11/0273
See application file for complete search history.

(56) References Cited

U.S. PATENT DOCUMENTS 3,921,240 A * 11/1975 Fyfe ..... E01D 19/047 14/73.5
4,078,623 A * 3/1978 Ohta ..... B66B 1/3484 177/132

(Continued)

FOREIGN PATENT DOCUMENTS

CN 102009900 A 4/2011
CN 102053678 A 5/2011

(Continued)

OTHER PUBLICATIONS

Office Action issued Jun. 30, 2016 in Chinese Patent Application No. 201380076009.4 (with Partial English translation and English translation of categories of cited documents).

(Continued)

*Primary Examiner* — Minh Truong
(74) *Attorney, Agent, or Firm* — Oblon, McClelland, Maier & Neustadt, L.L.P.

(57) ABSTRACT

An elevator car includes a car-platform device including a car-platform panel, anti-vibration devices, and a car-platform support frame. The car-platform panel includes a panel main body, a frame structure including a panel frame surrounding an outer peripheral portion of the panel main body, and a panel upper plate and a panel lower plate for individually covering upper surfaces and lower surfaces of the panel main body and the panel frame. The anti-vibration devices receive the frame structure by upper surfaces thereof. The car-platform support frame supports the car-platform panel through an intermediation of the anti-vibration devices. The upper surfaces of the anti-vibration devices are arranged at a height position between an upper surface and a lower surface of the car-platform panel in a vertical direction.

1 Claim, 10 Drawing Sheets

(56) References Cited

U.S. PATENT DOCUMENTS 4,113,064 A * 9/1978 Shigeta ..... B66B 1/34 187/251
4,744,429 A * 5/1988 Kellenbach ..... G01G 3/1402 177/211
4,865,157 A * 9/1989 Sissala ..... B66B 11/0273 187/410
4,899,852 A * 2/1990 Salmon ..... B66B 11/0286 187/411
5,005,671 A * 4/1991 Aime ..... B66B 11/0273 187/345
5,199,529 A * 4/1993 Salmon ..... B66B 11/0273 187/401
5,325,937 A * 7/1994 Suchodolski ..... B66B 11/0273 187/401
5,402,861 A * 4/1995 Kohara ..... B66B 11/0286 187/292
5,613,667 A 3/1997 Ho
6,082,698 A * 7/2000 Dubois ..... F16F 15/08 248/568
6,931,800 B2 * 8/2005 Sedrak ..... E01D 19/00 52/167.1
7,249,442 B2 * 7/2007 Pellegrino ..... A47F 5/0018 248/564
9,511,979 B2 * 12/2016 Maruyama ..... B66B 11/0206
2011/0056770 A1 * 3/2011 Qiu ..... B66B 11/02 187/266
2012/0048658 A1 * 3/2012 Brugger ..... B66B 11/0273 187/401

FOREIGN PATENT DOCUMENTS

| | | |
|---|---|---|
| JP | 51 137448 | 11/1976 |
| JP | 2 163280 | 6/1990 |
| JP | 3035583 | 3/1997 |
| JP | 2723328 | 3/1998 |
| JP | 2006 137513 | 6/2006 |
| JP | 2007 308290 | 11/2007 |
| JP | 2013 166616 | 8/2013 |

OTHER PUBLICATIONS

International Search Report issued Jun. 18, 2013, in PCT/JP2013/062389 filed Apr. 26, 2013.

Combined Office Action and Search Report issued Feb. 27, 2017 in Chinese Patent Application No. 201380076009.4 (with partial unedited computer generated English translation and English translation of categories of cited documents).

* cited by examiner

ELEVATOR CAR

TECHNICAL FIELD

The present invention relates to an elevator car, in which a car-platform panel is supported by a car-platform support frame through an intermediation of anti-vibration devices.

BACKGROUND ART

Hitherto, for weight reduction of a car platform, there is known a car-platform structure for an elevator, in which a honeycomb structure is used as a strength (reinforcement) member for the car platform, and the car platform is supported by a plank of a car frame through an intermediation of vibration isolation rubbers arranged at a bottom portion of the car platform (see Patent Literature 1).

CITATION LIST

Patent Literature

[PTL 1] JP 02-163280 A

SUMMARY OF INVENTION

Technical Problem

In the case of the related-art car-platform structure for an elevator as disclosed in Patent Literature 1, however, the vibration isolation rubbers are interposed between a lower surface of the car platform including the honeycomb structure and an upper surface of the plank of the car frame. Therefore, a distance between the car platform and the plank of the car frame increases to increase a thickness of the entire car-platform structure. As a result, a pit in a hoistway, which is located below a bottom floor, needs to have a large depth.

The present invention has been made to solve the problem described above and has an object to provide an elevator car capable of achieving weight reduction, suppressing vibration transferred to a car-platform panel, and of reducing a thickness of an entire car-platform device.

Solution to Problem

According to one embodiment of the present invention, there is provided an elevator car, including: a car-platform panel including: a panel main body; a frame structure including a panel frame surrounding an outer peripheral portion of the panel main body; and a panel upper plate and a panel lower plate for individually covering an upper surface and a lower surface of the panel main body and an upper surface and a lower surface of the panel frame; an anti-vibration device for receiving the frame structure by an upper surface thereof; and a car-platform support frame for supporting the car-platform panel through an intermediation of the anti-vibration device, the upper surface of the anti-vibration device being arranged at a height position between an upper surface and a lower surface of the car-platform panel in a vertical direction.

Advantageous Effects of Invention

According to the elevator car of the one embodiment of the present invention, a part of the anti-vibration device can be arranged within a range of a thickness of the car-platform panel in the vertical direction. As a result, the thickness of the car-platform device can be reduced. Moreover, vibration transferred from the car-platform support frame to the car-platform panel can be suppressed by the anti-vibration device. Further, the panel main body can be formed as a honeycomb structure. Thus, the car-platform panel can be reduced in weight.

DESCRIPTION OF EMBODIMENTS

Now, exemplary embodiments of the present invention are described with reference to the drawings.

First Embodiment

Figure 1:
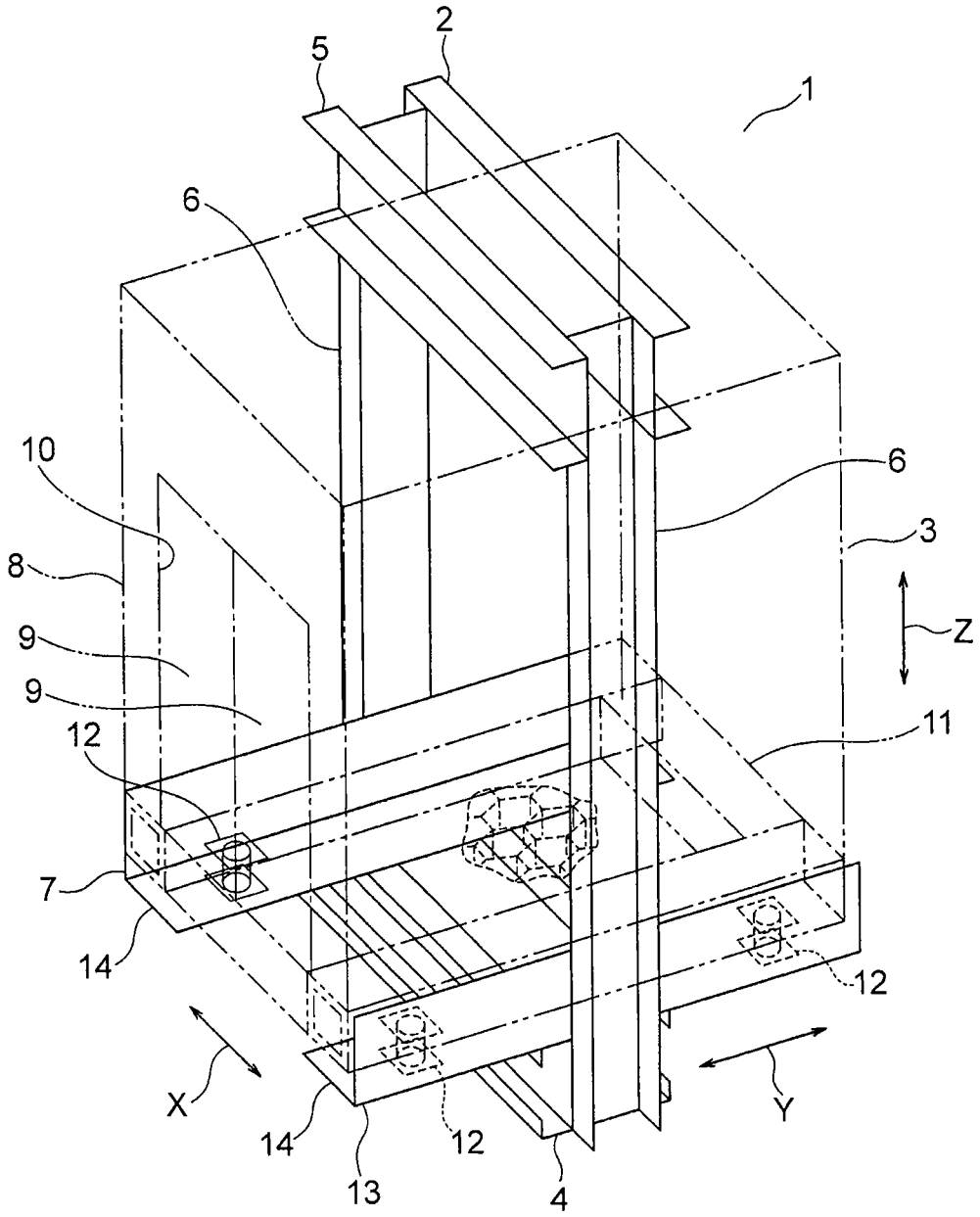
FIG. 1 is a perspective view for illustrating an elevator car according to a first embodiment of the present invention.

FIG. 1 is a perspective view for illustrating an elevator car according to a first embodiment of the present invention. In FIG. 1, a car (elevator car) 1 to be raised and lowered in a hoistway includes a car frame 2 suspended by a main rope (such as a rope or a belt) and a car main body 3 supported by the car frame 2.

The car frame 2 includes a plank 4 for supporting the car main body 3 from below, a crosshead 5 arranged above the car main body 3, and a pair of stiles 6 connecting both end portions of the plank 4 and the crosshead 5 to each other. In this example, the car frame 2 is arranged on a plane that is perpendicular to a depth direction of the car 1.

The car main body 3 includes a car-platform device 7 placed on the plank 4 and a cage 8 arranged on the car-platform device 7. A car doorway 10 to be opened and closed by car doors 9 is formed in the cage 8. A passenger can enter and exit the cage 8 through the car doorway 10. An opening-width direction of the car doorway 10 coincides with a width direction of the car 1. In FIG. 1, the width direction of the car 1 is illustrated as an X direction, the depth direction of the car 1 is illustrated as a Y direction, and a direction in which the car 1 is raised and lowered (vertical direction) is illustrated as a Z direction.

The car-platform device 7 includes a car-platform panel 11 arranged horizontally, a plurality of anti-vibration devices 12 for receiving the car-platform panel 11, and a car-platform support frame 13 fixed to the plank 4, for supporting the car-platform panel 11 through an intermediation of each of the anti-vibration devices 12.

The car-platform support frame 13 includes a pair of angle bars 14, each having an L-like sectional shape and extending in the depth direction of the car 1 (Y direction). The pair of angle bars 14 are arranged away from each other in the width direction of the car 1 (X direction). In this example, two anti-vibration devices 12 are placed on each of the angle bars 14. In total, four anti-vibration devices 12 are arranged on the car-platform support frame 13. The anti-vibration devices 12 placed on the same angle bar 14 are arranged away from each other in the depth direction of the car 1.

Figure 2:
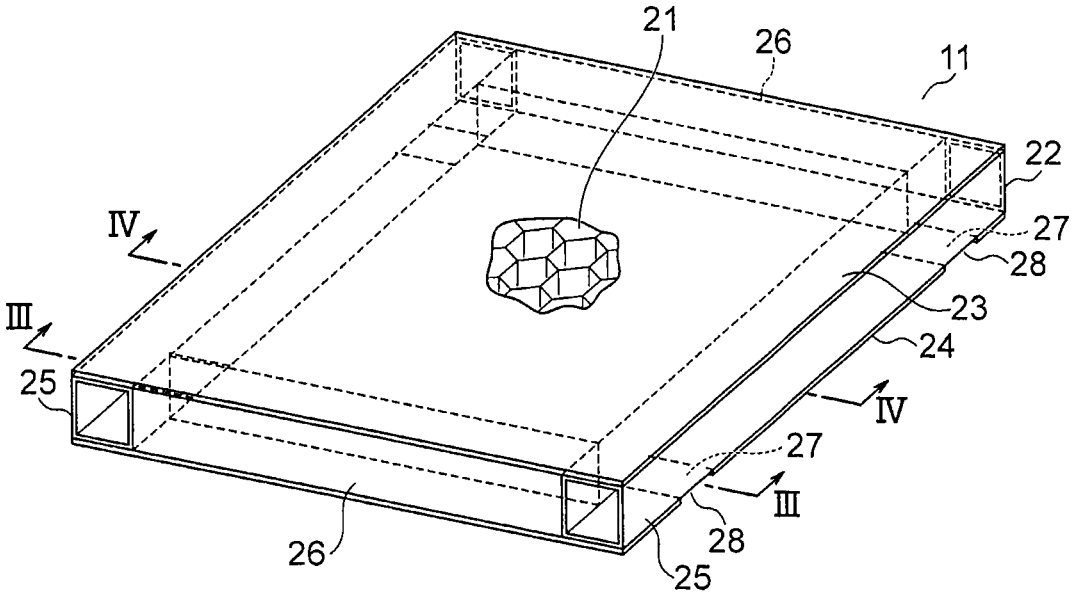
FIG. 2 is a partially broken perspective view for illustrating a car-platform panel illustrated in FIG. 1.
Figure 3:
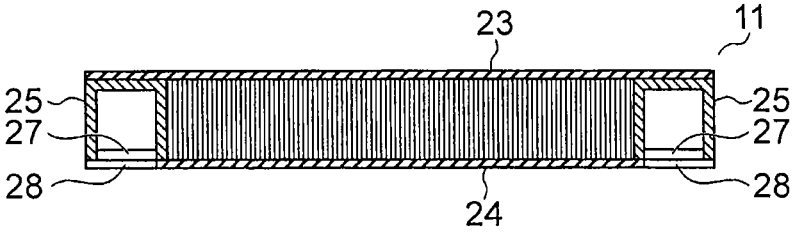
FIG. 3 is a sectional view taken along the line in FIG. 2.
Figure 4:
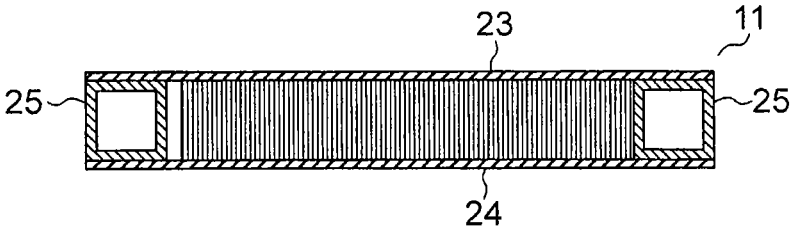
FIG. 4 is a sectional view taken along the line IV-IV in FIG. 2.

Here, FIG. 2 is a partially broken perspective view for illustrating the car-platform panel 11 illustrated in FIG. 1. FIG. 3 is a sectional view taken along the line in FIG. 2, and FIG. 4 is a sectional view taken along the line IV-IV in FIG. 2. The car-platform panel 11 includes a panel main body 21 that is a honeycomb structure made of aluminum with a rectangular outer shape, a panel frame 22 that surrounds an outer peripheral portion of the panel main body 21, a panel upper plate 23 having a rectangular shape, which is bonded to the panel main body 21 and the panel frame 22 to cover an upper surface of the panel main body 21 and an upper surface of the panel frame 22, and a panel lower plate 24 having a rectangular shape, which is bonded to the panel main body 21 and the panel frame 22 to cover a lower surface of the panel main body 21 and a lower surface of the panel frame 22.

The panel frame 22 is formed as a frame structure having higher strength than the panel main body 21. The panel frame 22 includes two vertical frame members 25 and two horizontal frame members 26 (a plurality of frame members 25 and 26) arranged along the outer peripheral portion of the panel main body 21. Each of the vertical frame members 25 is arranged along the depth direction of the car 1 (Y direction), whereas each of the horizontal frame members 26 is arranged along the width direction of the car 1 (X direction). The panel frame 22 is formed to have a rectangular frame-like shape by joining end portions of the vertical frame members 25 and end portions of the horizontal frame members 26.

Each of the vertical frame members 25 is a hollow member (tubular member) having a rectangular sectional shape, which extends in the depth direction of the car 1. Each of the horizontal frame members 26 is a hollow member (tubular member) having a rectangular sectional shape, which extends in the width direction of the car 1. In this example, each of the vertical frame members 25 and the horizontal frame members 26 is an extruded member made of aluminum.

Further, each of the vertical frame members 25 is a frame member for an anti-vibration device, which is placed on upper surfaces of the anti-vibration devices 12. The two anti-vibration devices 12 that receive the same vertical frame member 25 are arranged at positions on the vertical frame member 25 in a longitudinal direction while avoiding both end portions. On a lower surface of each of the vertical frame members 25, two frame opening portions 27 for bringing interior and exterior of the vertical frame member 25 into communication with each other are formed in alignment respectively with the positions of the anti-vibration devices 12. As a result, the sectional shape of each of the vertical frame members 25 is an open sectional shape (FIG. 3) that is open downward at the positions of the frame opening portions 27 and is a closed sectional shape (FIG. 4) that is closed at a position other than the frame opening portions 27.

A panel lower-plate cutout portion 28 is formed in a portion of the panel lower plate 24, which overlaps each of the frame opening portions 27. The panel lower-plate cutout portion 28 has approximately the same size as that of the frame opening portion 27. The size of each of the frame opening portions 27 and the panel lower-plate cutout portions 28 is such that the entire anti-vibration device 12 falls within a range of the frame opening portion 27 and the panel lower-plate cutout portion 28 when the anti-vibration device 12 is viewed along the vertical direction (Z direction). Further, in this example, a shape of each of the frame opening portions 27 and the panel lower-plate cutout portions 28 is rectangular.

Figure 5:
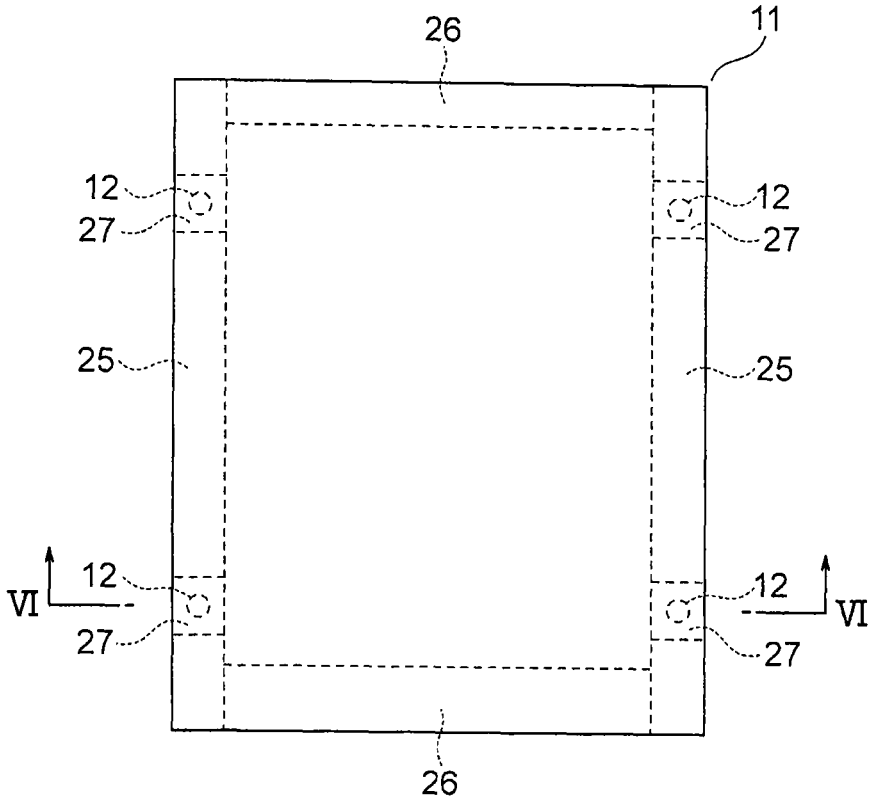
FIG. 5 is a top view for illustrating the car-platform panel illustrated in FIG. 1.
Figure 6:
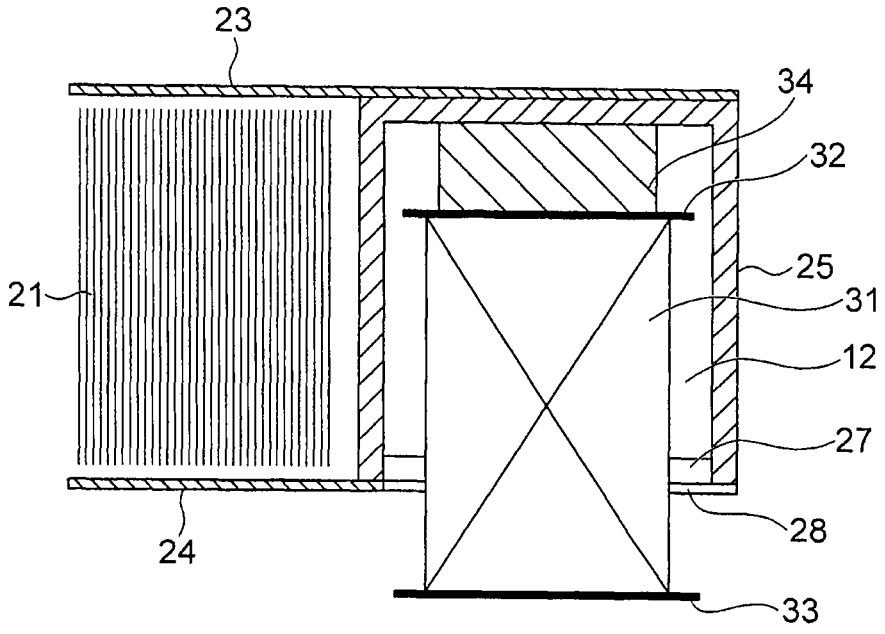
FIG. 6 is a sectional view taken along the line VI-VI in FIG. 5.

FIG. 5 is a top view for illustrating the car-platform panel 11 illustrated in FIG. 1. FIG. 6 is a sectional view taken along the line VI-VI in FIG. 5. Each of the anti-vibration devices 12 receives the panel frame 22 at the position of each of the frame opening portions 27, as illustrated in FIG. 5. Further, each of the anti-vibration devices 12 is a rubber vibration isolator including a rubber elastic member 31 having a columnar shape, an anti-vibration upper plate 32 bonded and fixed onto an upper surface of the rubber elastic member 31, and an anti-vibration lower plate 33 bonded and fixed onto a lower surface of the rubber elastic member 31, as illustrated in FIG. 6. An upper surface of the anti-vibration upper plate 32 forms an upper surface of the anti-vibration device 12, whereas a lower surface of the anti-vibration lower plate 33 forms a lower surface of the anti-vibration device 12.

An upper portion of each of the anti-vibration devices 12 is inserted into the vertical frame member 25 through the panel lower-plate cutout portion 28 and the frame opening portion 27. As a result, the upper surface of each of the anti-vibration devices 12 is arranged at a height position between an upper surface and a lower surface of the car-platform panel 11 in the vertical direction (Z direction). A non-elastic spacer 34 is interposed between the upper surface of each of the anti-vibration devices 12 and an upper surface of an internal space of the vertical frame member 25. Specifically, the non-elastic spacer 34 is interposed between each of the anti-vibration devices 12 and the vertical frame member 25 in the vertical direction. Each of the anti-vibration devices 12 receives the vertical frame member 25 by the upper surface of the anti-vibration device 12 through the spacer 34. The anti-vibration upper plate 32 of each of the anti-vibration devices 12 is fixed to the vertical frame member 25 together with the spacer 34 by a fastener (such as a bolt; not shown). Vibration transferred from the car-platform support frame 13 to the car-platform panel 11 is suppressed by elastic deformation of the rubber elastic member 31 of each of the anti-vibration devices 12.

Figure 7:
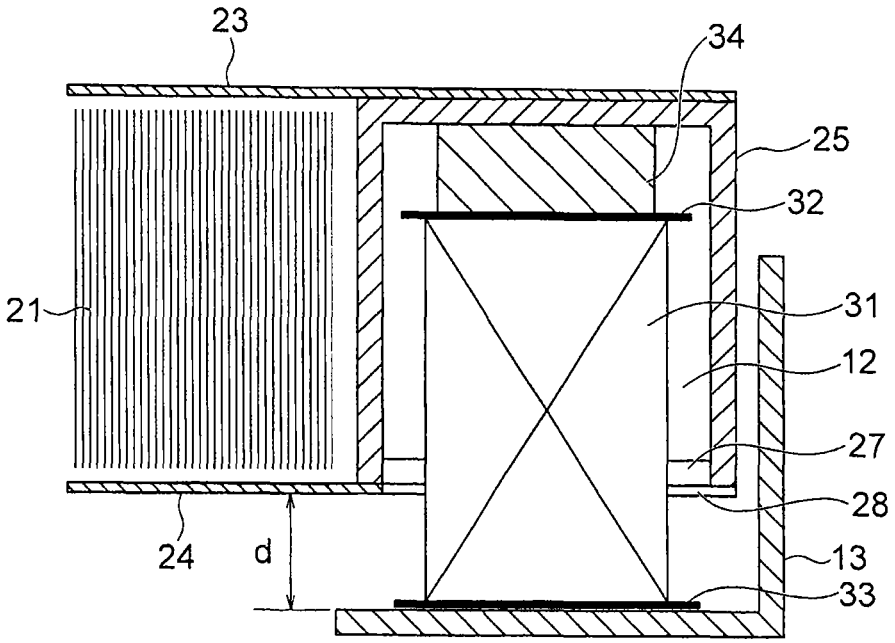
FIG. 7 is a sectional view for illustrating a state in which an anti-vibration device illustrated in FIG. 6 is mounted on a support surface of a car-platform support frame.

FIG. 7 is a sectional view for illustrating a state in which the anti-vibration device 12 illustrated in FIG. 6 is mounted on a support surface of the car-platform support frame 13. In FIG. 7, a main part of the car-platform device 7 when the car 1 is in a non-load state is illustrated. Each of the anti-vibration devices 12 is fixed by fastening the anti-vibration lower plate 33 to the support surface of the angle bar 14 of the car-platform support frame 13 by a fastener (such as a bolt; not shown). A height position of the lower surface of the car-platform panel 11 is maintained at a position higher than the support surface of the car-platform support frame 13 during a normal operation. A clearance dimension (car-platform device clearance dimension) d in the vertical direction (Z direction) between the support surface of the car-platform support frame 13 and the lower surface of the car-platform panel 11 is adjusted by adjustment of a thickness of the spacers 34.

The anti-vibration device 12 is compressed by a downward load applied from the car-platform panel 11. When the compressive load onto the anti-vibration device 12 increases, a compression amount of the anti-vibration device 12 increases to reduce the car-platform device clearance dimension d. When the compressive load onto the anti-vibration device 12 further increases, the car-platform device clearance dimension d becomes 0. As a result, the lower surface of the car-platform panel 11 comes into contact with the support surface of the car-platform support frame 13.

The car-platform device clearance dimension d when the car 1 is stopped in the non-load state is set to an initially set value that is larger than a supposed compression amount of the anti-vibration device 12 under a maximum load applied during a normal operation of the elevator (maximum load during a normal operation) and smaller than a supposed compression amount of the anti-vibration device 12 under a load applied at the time of emergency stop of the elevator (emergency load). The emergency load is a load generated by, for example, emergency stop of the car 1, which is made in case of overspeed abnormality. Therefore, the emergency load is larger than the load during the normal operation.

Figure 8:
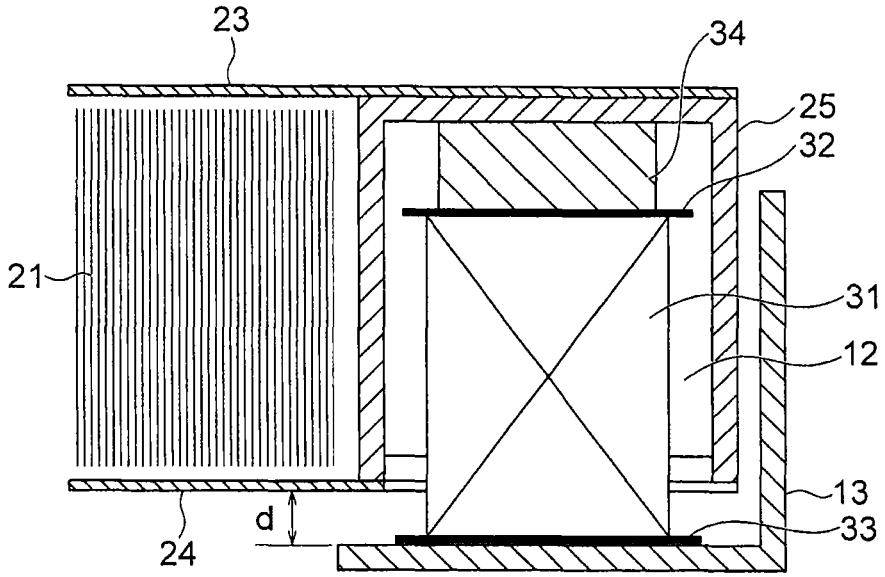
FIG. 8 is a sectional view for illustrating a main part of a car-platform device when the anti-vibration device illustrated in FIG. 7 is compressed during a normal operation.

FIG. 8 is a sectional view for illustrating a main part of the car-platform device 7 when the anti-vibration device 12 illustrated in FIG. 7 is compressed during the normal operation. During the normal operation, a load due to, for example, an inertial force generated by movement of the car 1 and weight of a passenger present on the car-platform panel 11 is applied to the anti-vibration device 12 to compress the anti-vibration device 12. The compression amount of the anti-vibration device 12 does not become equal to or larger than the initially set value. Therefore, for the car-platform device 7 during the normal operation, a state in which the lower surface of the car-platform panel 11 is away from the support surface of the car-platform support frame 13 is maintained, as illustrated in FIG. 8.

Figure 9:
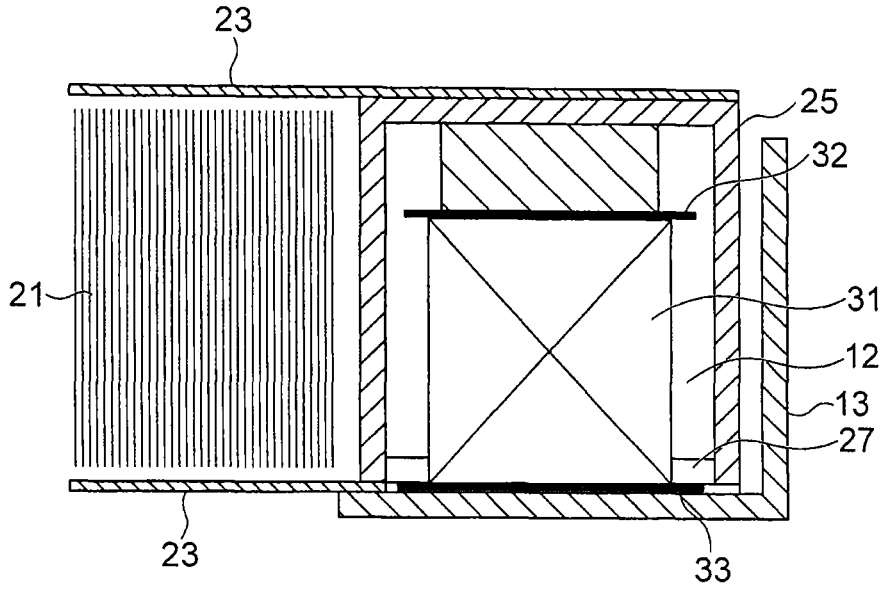
FIG. 9 is a sectional view for illustrating the main part of the car-platform device when the anti-vibration device illustrated in FIG. 7 is compressed at the time of emergency stop.

FIG. 9 is a sectional view for illustrating the main part of the car-platform device 7 when the anti-vibration device 12 illustrated in FIG. 7 is compressed at the time of emergency stop. At the time of emergency stop, for example, emergency stop of the car 1 that is moving down is made due to overspeed abnormality. As a result, a larger load than that during the normal operation is applied to the anti-vibration device 12 so that the compression amount of the anti-vibration device 12 becomes larger than that during the normal operation. As a result, when the emergency stop is made, the lower surface of the car-platform panel 11 is held in contact with the support surface of the car-platform support frame 13 (specifically, the car-platform device clearance dimension d becomes 0) in the car-platform device 7, as illustrated in FIG. 9. In a state in which the lower surface of the car-platform panel 11 is held in contact with the support surface of the car-platform support frame 13, the amount of increase in the downward load applied to the car-platform panel 11 is supported by a wide portion of the support surface of the car-platform support frame 13, which is held in contact with the lower surface of the car-platform panel 11. As a result, the load on each of the car-platform panel 11 and the car-platform support frame 13 is distributed.

In the car 1 described above, the anti-vibration devices 12 receive the panel frame 22 by the upper surfaces. The upper surfaces of the anti-vibration devices 12 are arranged at the height position between the upper surface and the lower surface of the car-platform panel 11 in the vertical direction. Therefore, a part of each of the anti-vibration devices 12 can be arranged within the range of the thickness of the car-platform panel 11 in the vertical direction. In this manner, the lower surface of the car-platform panel 11 can be arranged closer to the support surface of the car-platform support frame 13 by the dimension of the part of each of the anti-vibration devices 12, which is arranged within the range of the thickness of the car-platform panel 11. As a result, the thickness of the car-platform device 7 can be reduced. Further, the car-platform panel 11 is supported by the car-platform support frame 13 through an intermediation of the anti-vibration devices 12. Therefore, the vibration transferred from the car-platform support frame 13 to the car-platform panel 11 can also be suppressed by the anti-vibration devices 12. Further, the upper surfaces and the lower surfaces of the panel main body 21 and the panel frame 22 of the car-platform panel 11 are individually covered with the panel upper plate 23 and the panel lower plate 24. Therefore, the panel main body 21 can be formed as the lightweight honeycomb structure having high strength. Therefore, the car-platform panel 11 can be reduced in weight.

Further, the frame opening portions 27 are formed through the lower surfaces of the vertical frame members 25, each being formed as the hollow member. The anti-vibration devices 12 receive the vertical frame members 25 in a state in which the anti-vibration devices 12 are inserted into the vertical frame members 25 through the frame opening portions 27. Therefore, the upper surfaces of the anti-vibration devices 12 can be easily arranged at the height position between the upper surface and the lower surface of the car-platform panel 11 with a simple configuration.

Further, the spacers 34 are interposed between the upper surfaces of the anti-vibration devices 12 and the panel frame 22 in the vertical direction. The position of the car-platform panel 11 in the vertical direction with respect to the car-platform support frame 13 can be adjusted by adjusting the thickness of the spacers 34. In this manner, the clearance dimension d between the lower surface of the car-platform panel 11 and the support surface of the car-platform support frame 13 in the vertical direction can be appropriately adjusted. Inconvenience such as contact of the lower surface of the car-platform panel 11 with the car-platform support frame 13 during the normal operation can be prevented.

In order to reinforce a portion of each of the vertical frame members 25, in which the frame opening portion 27 is formed, a pair of bent portions may be formed on both longitudinal end portions of the anti-vibration upper plate 32 so that the anti-vibration upper plate 32 is used as a reinforcing member for the vertical frame member 25. In this case, the anti-vibration upper plate 32 is arranged in an internal space of the vertical frame member 25 in a state in which the pair of bent portions are opposed to each other in the longitudinal direction of the vertical frame member 25. Further, a width dimension of the anti-vibration upper plate 32 is determined so as to be fitted into the internal space of each of the vertical frame members 25 without clearance.

Further, a reinforcing member manufactured independently of the anti-vibration upper plate 32 may be fixed to each of the vertical frame members 25 together with the anti-vibration upper plate 32. In this case, as the reinforcing member, for example, a plate-like member having a pair of bent portions formed on both longitudinal end portions is used. The reinforcing member has a width dimension fitted into the internal space of each of the vertical frame members 25 without clearance and is arranged in the internal space of each of the vertical frame members 25 in a state in which the pair of bent portions are opposed to each other in the longitudinal direction of each of the vertical frame members 25.

In this manner, mounting of the anti-vibration devices 12 to the vertical frame members 25 and the reinforcement of the vertical frame members 25 can be achieved simultaneously.

Second Embodiment

Figure 10:
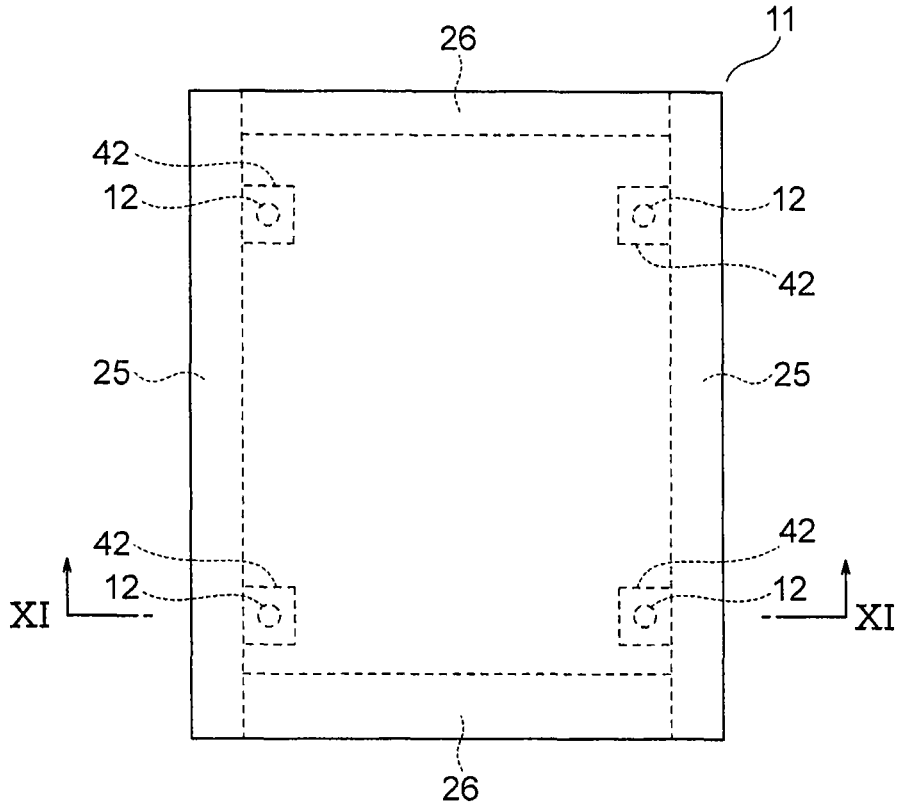
FIG. 10 is a top view for illustrating a car-platform panel according to a second embodiment of the present invention.
Figure 11:
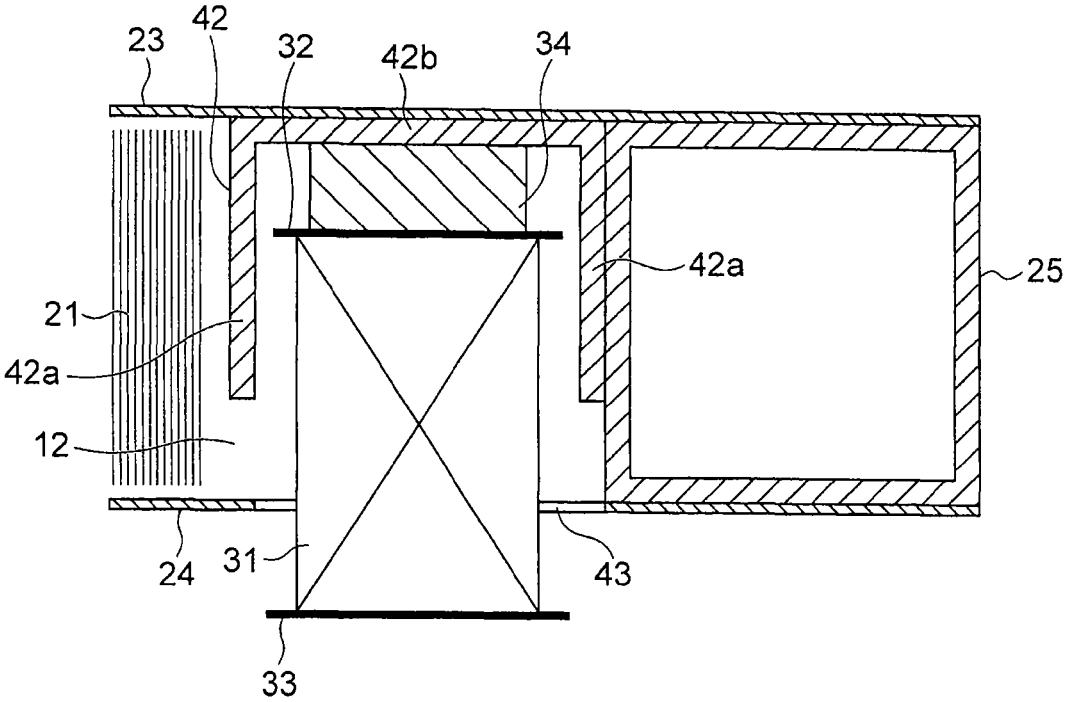
FIG. 11 is a sectional view taken along the line XI-XI in FIG. 10.

FIG. 10 is a top view for illustrating a car-platform panel 11 according to a second embodiment of the present invention. FIG. 11 is a sectional view taken along the line XI-XI in FIG. 10. The car-platform panel 11 includes the panel main body 21, a frame structure 41, the panel upper plate 23, and the panel lower plate 24. The frame structure 41 includes the panel frame 22 and a plurality of (four in this example) frame inner fixing members 42 fixed to the panel frame 22 on an inner side of the panel frame 22.

In this example, the frame opening portions 27 are not formed in the vertical frame members 25 of the panel frame 22. Therefore, in this example, a sectional shape of each of the vertical frame members 25 is a closed sectional shape at any position on the vertical frame member 25 in the longitudinal direction. The remaining configuration of the panel frame 22 is the same as that of the first embodiment.

On an outer peripheral portion of the panel main body 21, a plurality of panel main-body grooves that respectively form spaces in which the frame inner fixing members 42 are arranged are formed in the vertical direction (thickness direction of the panel main body 21) between the panel main body 21 and the panel frame 22. Each of the frame inner fixing members 42 is arranged in the space formed by each of the panel main-body grooves between the panel main body 21 and the panel frame 22. The remaining configuration of the panel main body 21 is the same as that of the first embodiment.

The number of the frame inner fixing members 42 is set equal to the number of the anti-vibration devices 12. In this example, two frame inner fixing members 42 are fixed to a side surface of each of the vertical frame members 25, and therefore, four frame inner fixing members 42 are fixed to the panel frame 22 in total. The frame inner fixing members 42 fixed to the same vertical frame member 25 are arranged away from each other in the longitudinal direction of the vertical frame member 25. Each of the frame inner fixing members 42 is fixed to the vertical frame member 25 in a state in which an upper surface thereof is held in contact with a back surface of the panel upper plate 23.

Each of the frame inner fixing members 42 is a hollow member made of aluminum with an open lower portion. Further, each of the frame inner fixing members 42 includes a pair of vertical plate portions 42*a* opposed to each other in a horizontal direction and a horizontal plate portion 42*b* fixed between upper end portions of the pair of vertical plate portions 42*a*. As a result, a sectional shape of the frame inner fixing member 42 is rectangular with an open lower side. Each of the frame inner fixing members 42 is arranged so that one of the vertical plate portions 42 is fixed to the side surface of the vertical frame member 25 and an upper surface of the horizontal plate portion 42*b* is held in contact with the back surface of the panel upper plate 23.

The panel lower-plate cutout portions 28 as in the first embodiment are not formed through the panel lower plate 24. A plurality of (four in this example) panel lower-plate opening portions 43 are formed in alignment with the respective positions of the frame inner fixing members 42. In this manner, a space below each of the frame inner fixing members 42 is open to the outside of the car-platform panel 11 through the panel lower-plate opening portion 43. The remaining configuration of the panel lower plate 24 is the same as that of the first embodiment.

The anti-vibration devices 12 are respectively arranged in alignment with the positions of the frame inner fixing members 42. Each of the anti-vibration devices 12 receives the horizontal plate portion 42*b* of the frame inner fixing member 42 by the upper surface through an intermediation of the spacer 34 in a state in which the anti-vibration device 12 is inserted from below the car-platform panel 11 through the panel lower-plate opening portion 43 into the frame inner fixing member 42 inside the panel frame 22. The anti-vibration upper plate 32 of each of the anti-vibration devices 12 is fixed to the horizontal plate portion 42*b* together with the spacer 34 by a fastener (such as a bolt; not shown). As a result, the upper surfaces of the anti-vibration devices 12 are arranged at a height position between the upper surface and the lower surface of the car-platform panel 11 in the vertical direction. The remaining configuration is the same as that of the first embodiment.

As described above, the frame inner fixing members 42 are fixed to the panel frame 22 on the inner side of the panel frame 22, while the anti-vibration devices 12 receive the frame inner fixing members 42 in a state in which the anti-vibration devices 12 are inserted into the panel frame 22 through the panel lower-plate opening portions 43. Therefore, a distance between the anti-vibration devices 12 in the width direction (X direction) of the car 1 can be set smaller than that in the first embodiment. As a result, a deflection amount of the car-platform panel 11 when the car-platform panel 11 is subjected to the load can be reduced. Further, the frame opening portions 27 for mounting the anti-vibration devices 12 to the panel frame 22 are not formed in the panel frame 22. Thus, the strength of the panel frame 22 can be prevented from being lowered by forming the frame opening portions 27.

In the example described above, the hollow members, each having the rectangular cross section with the open lower portion, are used as the frame inner fixing members 42. However, the shape of each of the frame inner fixing members 42 is not limited thereto. For example, the shape of the frame inner fixing member 42 may be a rectangular parallelepiped shape, and the sectional shape of the frame inner fixing member 42 may be an L-like shape.

Third Embodiment

Figure 12:
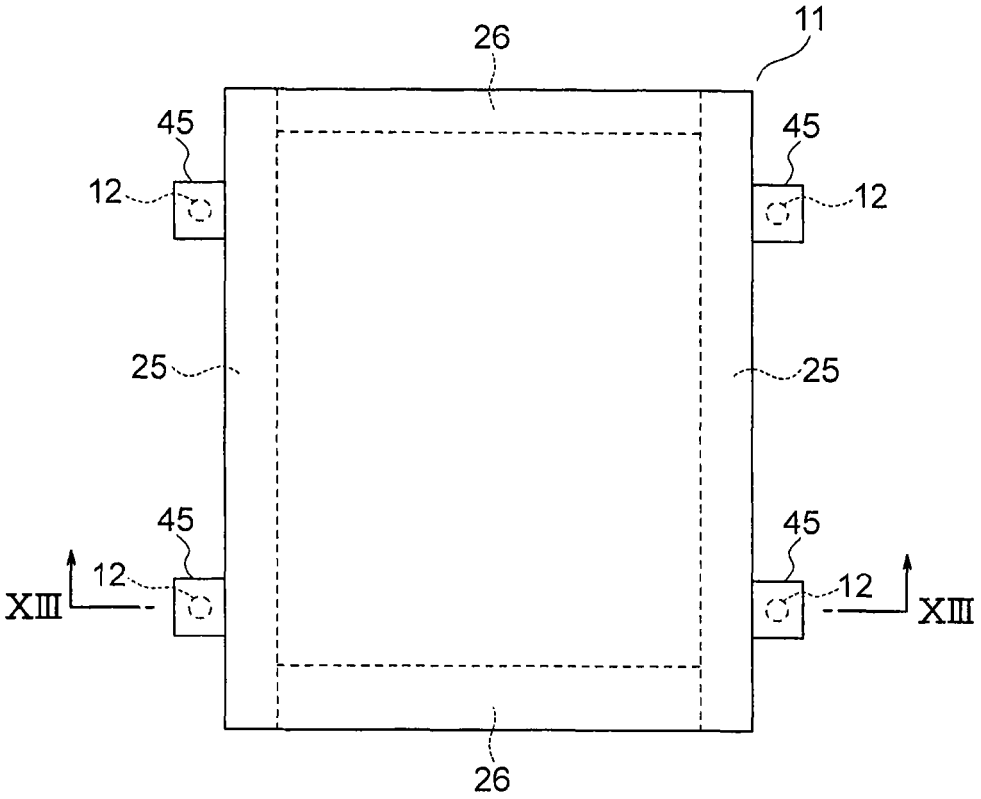
FIG. 12 is a top view for illustrating a car-platform panel according to a third embodiment of the present invention.
Figure 13:
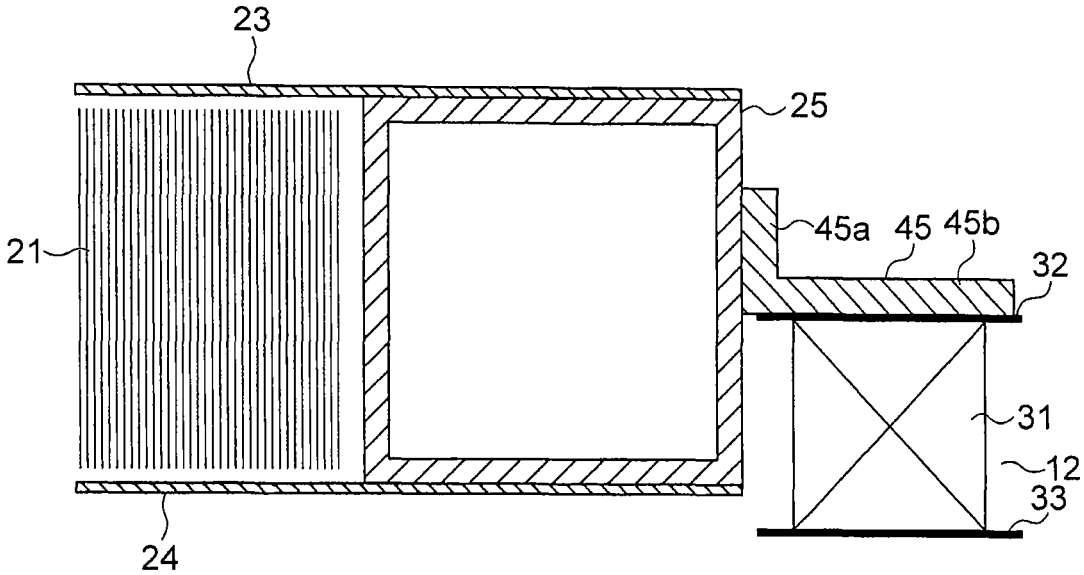
FIG. 13 is a sectional view taken along the line XIII-XIII in FIG. 12.

FIG. 12 is a top view for illustrating a car-platform panel 11 according to a third embodiment of the present invention. FIG. 13 is a sectional view taken along the line XIII-XIII in FIG. 12. The car-platform panel 11 includes the panel main body 21, the frame structure 41, the panel upper plate 23, and the panel lower plate 24. The frame structure 41 includes the panel frame 22 and a plurality of (four in this example) frame outer fixing members 45 fixed to the panel frame 22 on an outer side of the panel frame 22. Configurations of the panel main body 21 and the panel upper plate 23 are the same as those of the first embodiment. Further, a configuration of the panel lower plate 24 is the same as that of the first embodiment except that the panel lower-plate cutout portions 28 are not formed.

In this example, the frame opening portions 27 are not formed in the vertical frame members 25 of the panel frame 22. Therefore, in this example, a sectional shape of each of the vertical frame members 25 is a closed sectional shape at any position on the vertical frame member 25 in the longitudinal direction. The remaining configuration of the panel frame 22 is the same as that of the first embodiment.

The number of the frame outer fixing members 45 is set equal to the number of the anti-vibration devices 12. In this example, two frame outer fixing members 45 are fixed to the side surface of each of the vertical frame members 25, and therefore, four frame outer fixing members 45 are fixed to the panel frame 22 in total. The frame outer fixing members 45 fixed to the same vertical frame member 25 are arranged away from each other in the longitudinal direction of the vertical frame member 25. The frame outer fixing members 45 are arranged at positions that are out of a range of the panel upper plate 23 and a range of the panel lower plate 24 when the car-platform panel 11 is viewed along the vertical direction (thickness direction).

Each of the frame outer fixing members 45 is a strength member made of aluminum with an L-shaped cross section. Specifically, each of the frame outer fixing members 45 includes a vertical plate portion 45*a* fixed to the side surface of the vertical frame member 25 and a horizontal plate portion 45*b* extending horizontally from a lower end portion of the vertical plate portion 45*a* in a direction away from the vertical frame member 25. Each of the frame outer fixing members 45 is arranged so as to fall within a dimensional range between the upper surface and the lower surface of the car-platform panel 11.

The anti-vibration devices 12 are respectively arranged in alignment with the positions of the frame outer fixing members 45. Each of the anti-vibration devices 12 receives the horizontal plate portion 45*b* of the frame outer fixing member 45 by the upper surface. In this example, the spacer 34 is not interposed between the upper surface of each of the anti-vibration devices 12 and the horizontal plate portion 45*b* of the frame outer fixing member 45. Therefore, the anti-vibration upper plate 32 of the anti-vibration device 12 is fixed to the frame outer fixing member 45 by a fastener (such as a bolt; not shown) in a state in which the anti-vibration upper plate 32 is held in contact with the horizontal plate portion 45*b*. As a result, the upper surface of the anti-vibration device 12 is arranged at a height position between the upper surface and the lower surface of the car-platform panel 11 in the vertical direction. The car-platform device clearance dimension d between the lower surface of the car-platform panel 11 and the support surface of the car-platform support frame 13 is adjusted by vertically adjusting a position on the panel frame 22 (vertical frame member 25), at which the frame outer fixing member 45 is fixed. The remaining configuration is the same as that of the first embodiment.

As described above, the frame outer fixing members 45 are fixed to the panel frame 22 on the outer side of the panel frame 22, and the anti-vibration devices 12 receive the frame outer fixing members 45. Therefore, an opening portion or the like is not required to be formed in any of the panel main body 21, the panel frame 22, the panel upper plate 23, and the panel lower plate 24. Thus, the strength (rigidity) of the car-platform panel 11 can be prevented from being lowered, while manufacture of the car-platform panel 11 can be facilitated. Further, work of mounting the anti-vibration devices 12 to the car-platform panel 11 can be performed on the outer side of the car-platform panel 11. Thus, installation work for the car-platform device 7 can be facilitated.

In the example described above, the member having the L-like cross section is used as the frame outer fixing member 45. However, the shape of each of the frame outer fixing members 45 is not limited thereto. For example, similarly to the frame inner fixing members 42 of the second embodiment, a hollow member having a rectangular cross section with an open lower portion may be used as each of the frame outer fixing members 45. Further, the shape of each of the frame outer fixing members 45 may also be a rectangular parallelepiped shape.

Fourth Embodiment

Figure 14:
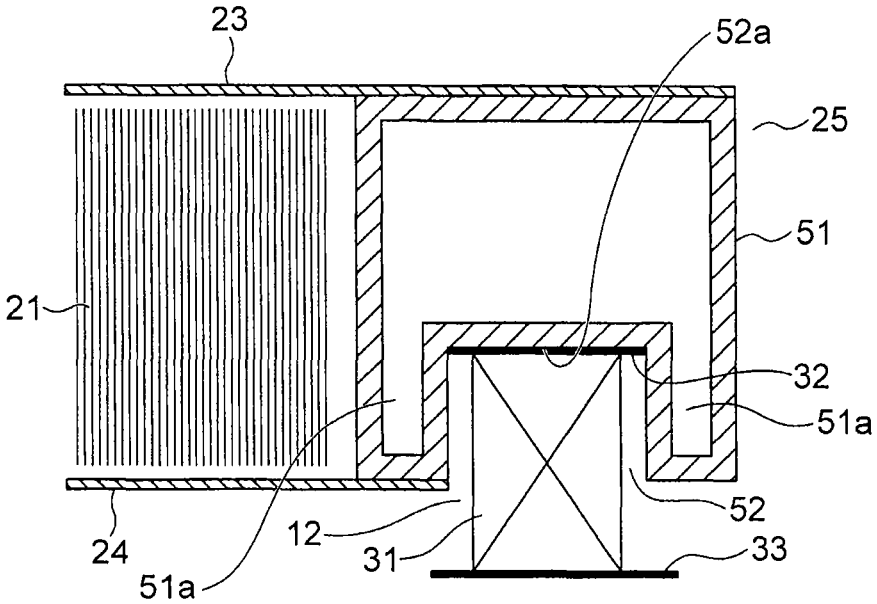
FIG. 14 is a sectional view for illustrating a main part of a car-platform device according to a fourth embodiment of the present invention.

FIG. 14 is a sectional view for illustrating a main part of a car-platform device 7 according to a fourth embodiment of the present invention. FIG. 14 is a sectional view corresponding to FIG. 6 in the first embodiment. Each of the vertical frame members 25 used as the frame member for an anti-vibration device includes a frame member main body 51 that is a hollow member extending in the longitudinal direction of the vertical frame members 25. A lower surface of the frame member main body 51 forms a lower surface of the vertical frame member 25.

A concave portion 52 is formed on the lower surface of the frame member main body 51. The concave portion 52 is formed on the lower surface of the frame member main body 51 without forming an open portion in a cross section of the frame member main body 51. As a result, a bottom surface 52*a* of the concave portion 52 is formed at a height position between the upper surface and the lower surface of the vertical frame member 25. Further, the concave portion 52 is formed as a groove portion along a longitudinal direction of the frame member main body 51. A sectional shape of the frame member main body 51 is the same at any position in the longitudinal direction of the frame member main body 51.

The concave portion 52 is formed in an intermediate portion of the lower surface of the frame member main body 51 in a width direction. As a result, a part of the frame member main body 51 is formed as a pair of groove wall portions 51*a* on both sides of the concave portion 52 in the width direction. Onto a lower surface of one groove wall portion 51*a* of the pair of groove wall portions 51*a*, which is closer to the panel main body 21, the panel lower plate 24 is overlapped and bonded.

Each of the anti-vibration devices 12 receives the frame member main body 51 by the upper surface in a state in which the anti-vibration device 12 is inserted into the concave portion 52. As a result, the upper surface of the anti-vibration device 12 is arranged at a height position between the upper surface and the lower surface of the car-platform panel 11 in the vertical direction. In this example, the spacer 34 is not interposed between the upper surface of the anti-vibration device 12 and the bottom surface 52*a* of the concave portion 52. Therefore, the anti-vibration upper plate 32 of the anti-vibration device 12 is fixed to the frame member main body 51 by a fastener (such as a bolt; not shown) in a state in which the anti-vibration upper plate 32 is held in contact with the bottom surface 52*a* of the concave portion 52. The remaining configuration is the same as that of the first embodiment.

As described above, each of the vertical frame members 25 includes the frame member main body 51 that is the hollow member having the concave portion 52 formed on the lower surface. The anti-vibration devices 12 receive the frame member main bodies 51 in a state in which the anti-vibration devices 12 are inserted into the concave portions 52. Therefore, an opening portion or the like is not required to be formed in the panel frame 22. Thus, the strength (rigidity) of the car-platform panel 11 can be prevented from being lowered, while the manufacture of the car-platform panel 11 can be facilitated.

Fifth Embodiment

Although the concave portion 52 is formed in the intermediate portion of the lower surface of the frame member main body 51 in the width direction in the fourth embodiment, the concave portion 52 formed on the lower surface of the frame member main body 51 may also be open to the outside of the panel frame 22.

Figure 15:
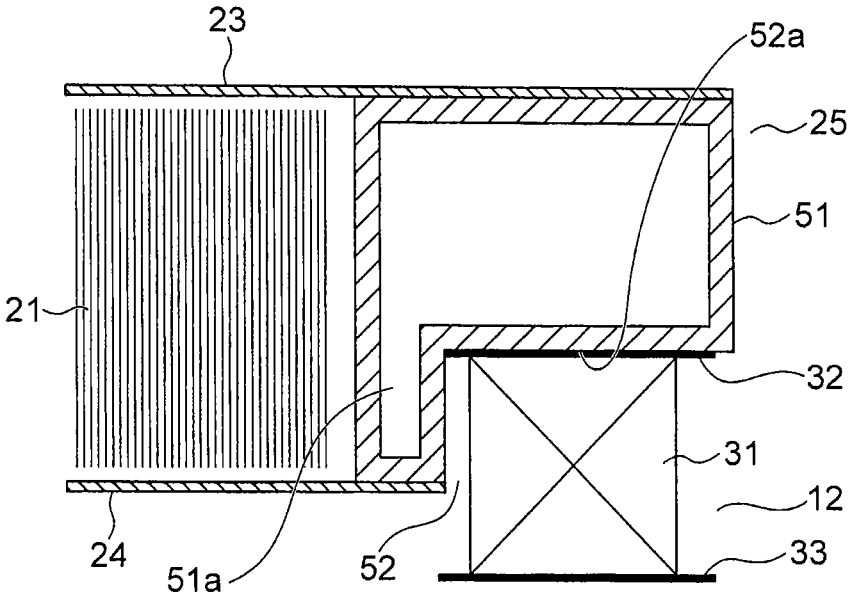
FIG. 15 is a sectional view for illustrating a main part of a car-platform device according to a fifth embodiment of the present invention.

Specifically, FIG. 15 is a sectional view for illustrating a main part of a car-platform device 7 according to a fifth embodiment of the present invention. FIG. 15 is a sectional view corresponding to FIG. 6 in the first embodiment. On the lower surface of the frame member main body 51, the concave portion 52 that is open to the outside of the panel frame 22 is formed. As a result, the groove wall portion 51*a* that is a part of the frame member main body 51 is formed only on a side closer to the panel main body 21 of both sides of the concave portion 52 in the width direction. Onto a lower surface of the groove wall portion 51*a*, the panel lower plate 24 is overlapped and bonded. The remaining configuration is the same as that of the fourth embodiment.

As described above, the concave portion 52 that is formed on the lower surface of the frame member main body 51 is open to the outside of the panel frame 22. Therefore, the area of the bottom surface 52*a* of the concave portion 52 can be set larger than that in the fourth embodiment. Thus, an installation space for the anti-vibration device 12 can be increased in the horizontal direction. Further, the anti-vibration devices 12 can be easily placed from the outside of the panel frame 22. The installation of the car-platform device 7 can be facilitated.

Sixth Embodiment

In order to ensure the strength (rigidity) of the vertical frame members 25, a reinforcing portion may be formed on the frame member main body 51 described in the fifth embodiment.

Figure 16:
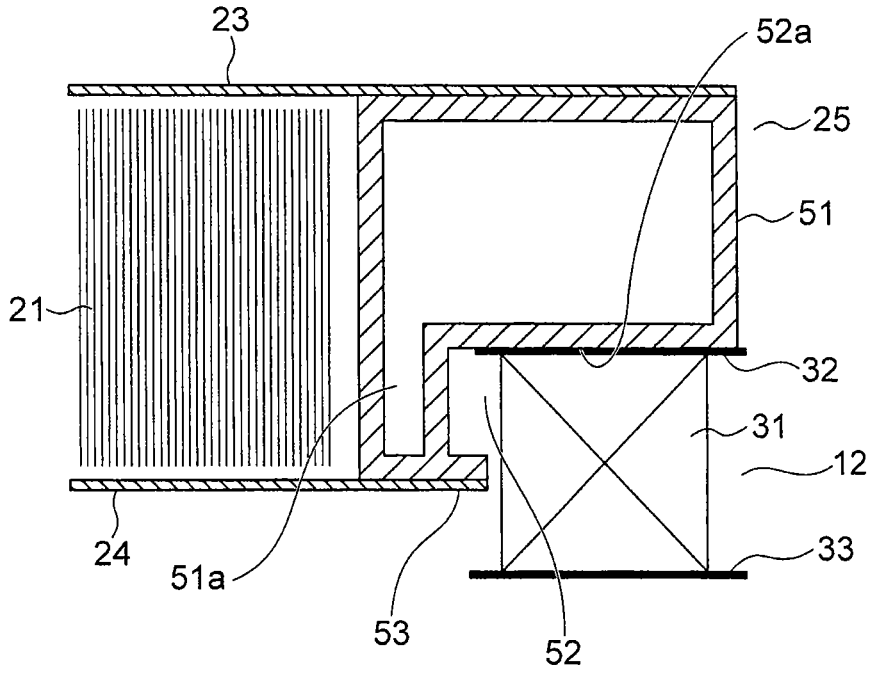
FIG. 16 is a sectional view for illustrating a main part of a car-platform device according to a sixth embodiment of the present invention.

Specifically, FIG. 16 is a sectional view for illustrating a main part of a car-platform device 7 according to a sixth embodiment of the present invention. FIG. 16 is a sectional view corresponding to FIG. 6 in the first embodiment. The vertical frame member 25 includes the frame member main body 51 similar to that of the fifth embodiment and a reinforcing portion 53 formed on the frame member main body 51 along the longitudinal direction of the frame member main body 51. A sectional shape of the frame member main body 51 is the same at any position in the longitudinal direction of the frame member main body 51.

The reinforcing portion 53 projects from an inner surface of the concave portion 52 while extending the lower surface of the frame member main body 51. Specifically, the reinforcing portion 53 projects from a lower end portion of the groove wall portion 51*a* of the frame member main body 51 toward the outside of the panel frame 22. The lower surface of the vertical frame member 25 is formed by the lower surface of the groove wall portion 51*a* of the frame member main body 51 and a lower surface of the reinforcing portion 53. Onto the lower surface of the vertical frame member 25, the panel lower plate 24 is overlapped and bonded. Each of the anti-vibration devices 12 is inserted into the concave portion 52 while avoiding the reinforcing portion 53. The remaining configuration is the same as that of the fifth embodiment.

As described above, each of the vertical frame members 25 includes the reinforcing portion 53 projecting from the inner surface of the concave portion 52 while extending the lower surface of the frame member main body 51, and the panel lower plate 24 is overlapped on the lower surface of the reinforcing portion 53. Therefore, the strength (rigidity) of the vertical frame member 25 can be easily ensured, while the area of the vertical frame member 25, over which the panel lower plate 24 is bonded, can be set larger than that in the fifth embodiment. Thus, fixing strength of the panel lower plate 24 to the panel frame 22 can be improved.

Seventh Embodiment

Figure 17:
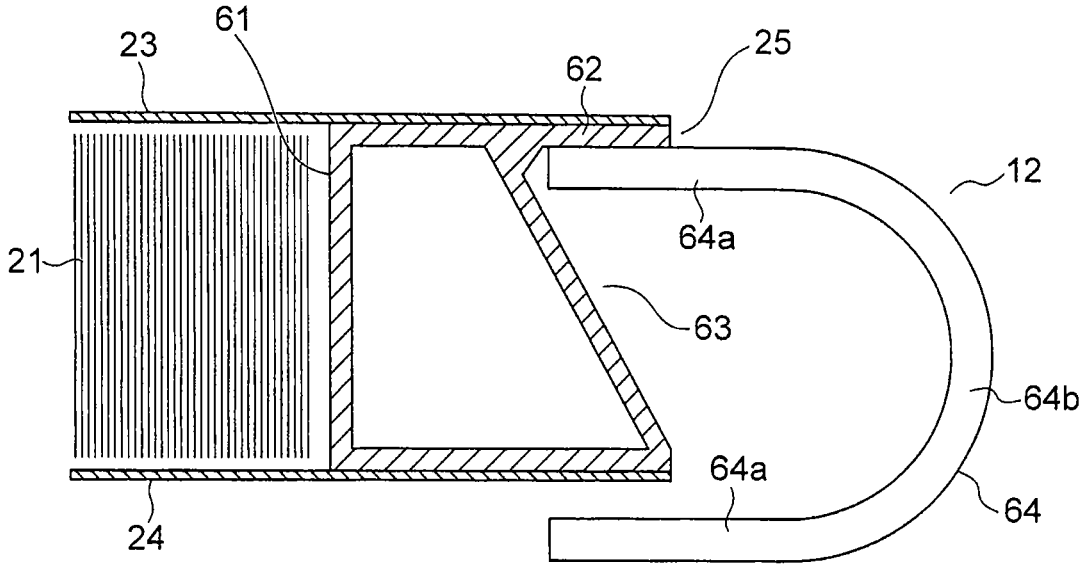
FIG. 17 is a sectional view for illustrating a main part of a car-platform device according to a seventh embodiment of the present invention.

FIG. 17 is a sectional view for illustrating a main part of a car-platform device 7 according to a seventh embodiment of the present invention. FIG. 17 is a sectional view corresponding to FIG. 6 in the first embodiment. Each of the vertical frame members 25 that are the frame members for an anti-vibration device includes a frame member main body 61 that is a hollow member extending in the longitudinal direction of the vertical frame member 25 and a projecting portion 62 formed on the frame member main body 61 along a longitudinal direction of the frame member main body 61. A sectional shape of the vertical frame member 25 is the same at any position in the longitudinal direction of the vertical frame member 25.

A sectional shape of the frame member main body 61 is trapezoidal so that a width dimension of an upper surface is smaller than a width dimension of a lower surface, an inner side surface of two side surfaces, which is closer to the panel main body 21, is perpendicular to the upper surface and the lower surface, and an outer side surface away from the panel main body 21 is inclined with respect to the upper surface and the lower surface. Therefore, the outer side surface of the frame member main body 61 is an inclined surface that is inclined in a direction closer to the panel main body 21 from the lower surface toward the upper surface.

The projecting portion 62 projects to the outside of the panel frame 22 while extending the upper surface of the frame member main body 61 from an upper end portion of the frame member main body 61. The upper surface of the vertical frame member 25 is formed by the upper surface of the frame member main body 61 and an upper surface of the projecting portion 62. The panel upper plate 23 is overlapped and bonded onto the upper surface of the vertical frame member 25. A lower surface of the vertical frame member 25 is formed only by the lower surface of the frame member main body 61. The panel lower plate 24 is overlapped and bonded onto the lower surface of the vertical frame member 25. A width dimension of the upper surface and a width dimension of the lower surface of the vertical frame member 25 are set equal to each other. An open portion 63, which is formed by the outer side surface of the frame member main body 61 and the lower surface of the projecting portion 62 and is open to the outside of the panel frame 22, is formed in the vertical frame member 25.

Each of the anti-vibration devices 12 receives the projecting portion 62 by the upper surface in a state in which the anti-vibration device 12 is inserted in the open portion 63. Each of the anti-vibration devices 12 includes a flat spring 64 having a U-like shape. The flat spring 64 includes a pair of opposed plate portions 64*a* that are opposed to each other and a curved plate portion 64*b* that connects end portions of the pair of opposed plate portions 64*a*. The flat spring 64 includes the curved plate portion 64*b* that is arranged outside of the panel frame 22 and receives the projecting portion 62 in a state in which one of the opposed plate portions 64*a* is inserted into the open portion 63 and another of the opposed plate portions 64*a* is arranged below the car-platform panel 11. The upper surface of the anti-vibration device 12 is formed by an upper surface of the one of the opposed plate portions 64*a* that is inserted into the open portion 63 of the vertical frame member 25. In this manner, the upper surface of the anti-vibration device 12 is arranged at a height position between the upper surface and the lower surface of the car-platform panel 11 in the vertical direction. Vibration from the car-platform support frame 13 to the car-platform panel 11 is suppressed by elastic deformation of the flat spring 64.

In this example, the spacer 34 is not interposed between the upper surface of the anti-vibration device 12 and the lower surface of the projecting portion 62. Therefore, the one of the opposed plate portions 64*a* of the flat spring 64 is fixed to the projecting portion 62 by a fastener (such as a bolt; not shown) in a state in which the one of the opposed plate portions 64*a* is held in contact with the lower surface of the projecting portion 62. The remaining configuration is the same as that of the first embodiment.

As described above, each of the vertical frame members 25 includes the frame member main body 61 that is the hollow member and the projecting portion 62 projecting from the frame member main body 61 to the outside of the panel frame 22. Each of the anti-vibration devices 12 receives the projecting portion 62. Therefore, an opening portion or the like is not required to be formed in the frame member main body 61. Thus, the strength (rigidity) of the car-platform panel 11 can be prevented from being lowered, while the manufacture of the car-platform panel 11 can be facilitated. Further, the work of mounting the anti-vibration devices 12 to the panel frame 22 can be performed outside of the car-platform panel 11. Thus, the installation work for the car-platform device 7 can be facilitated.

Further, each of the anti-vibration devices 12 includes the flat spring 64 having the U-like shape. Therefore, although the frame member main body 61 overhangs below the projecting portion 62, the upper portion of the anti-vibration device 12 can be inserted below the projecting portion 62 from the side of the vertical frame 25 while avoiding the overhanging portion of the frame member main body 61.

Figure 18:
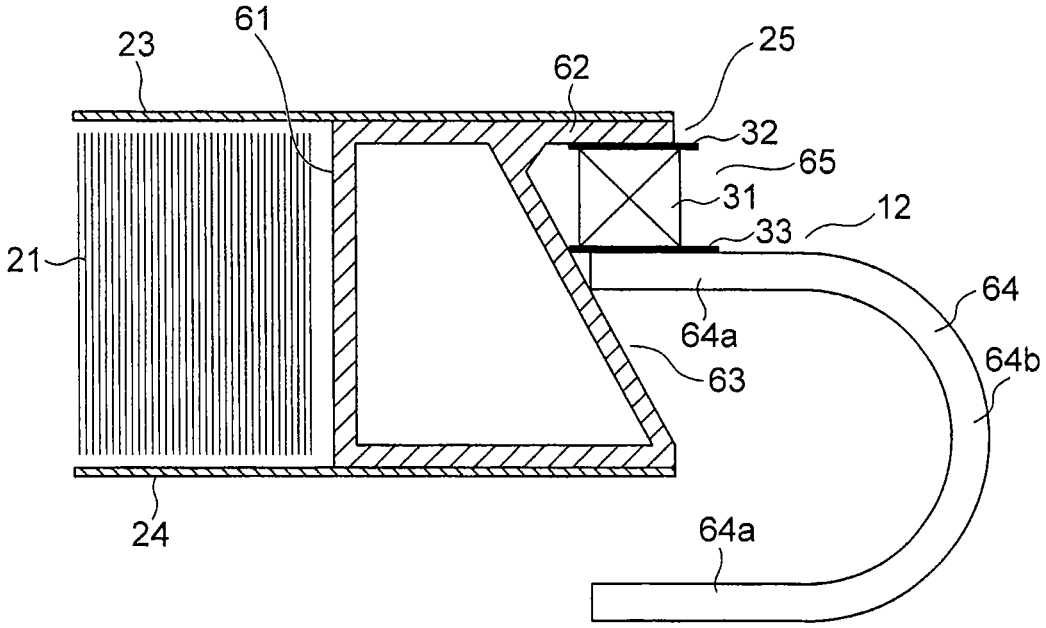
FIG. 18 is a sectional view for illustrating another example of the main part of the car-platform device according to the seventh embodiment of the present invention.

In the example described above, the anti-vibration device 12 includes the flat spring 64 alone. However, the anti-vibration device 12 may also include a rubber vibration isolator 65 similar to that of the first embodiment including the rubber elastic member 31, the anti-vibration upper plate 32, and the anti-vibration lower plate 33 in addition to the flat spring 64. In this case, as illustrated in FIG. 18, the rubber vibration isolator 65 is placed on the flat spring 64 so that the rubber vibration isolator 65 is arranged between the lower surface of the projecting portion 62 and the upper surface of the flat spring 64. As a result, the anti-vibration device 12 receives the projecting portion 62 by the upper surface of the rubber vibration isolator 65.

Eighth Embodiment

Figure 19:
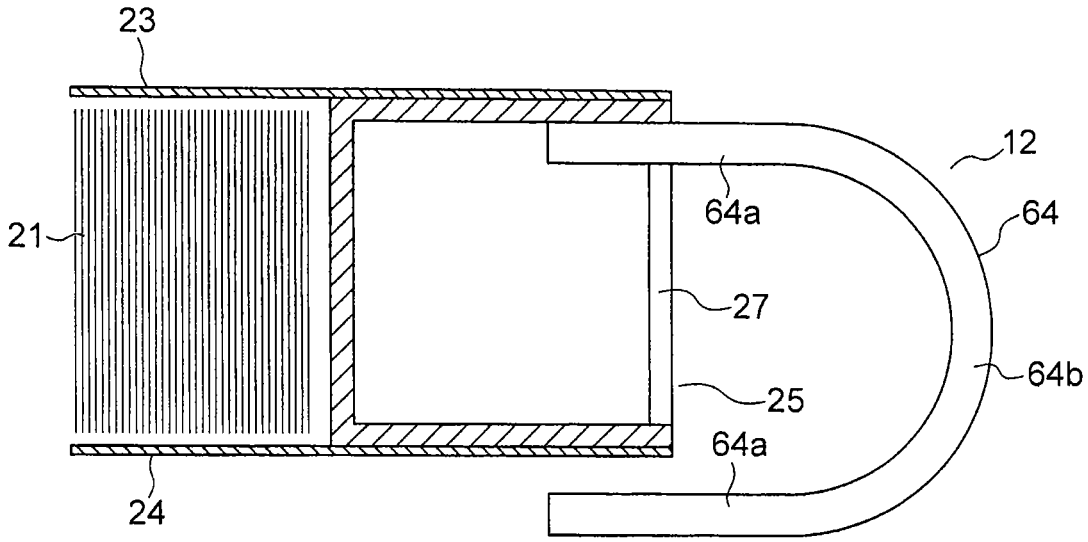
FIG. 19 is a sectional view for illustrating a main part of a car-platform device according to an eighth embodiment of the present invention.

FIG. 19 is a sectional view for illustrating a main part of a car-platform device according to an eighth embodiment of the present invention. FIG. 19 is a sectional view corresponding to FIG. 6 in the first embodiment. On a side surface of both side surfaces of each of the vertical frame members 25 that are the frame members for an anti-vibration device, which is located away from the panel main body 21 (specifically, a side surface located on an outer side of the panel frame 22), the frame opening portion 27 for bringing the interior and the exterior of the vertical frame member 25 into communication with each other is formed. Two frame opening portions 27 are formed in alignment with the positions of the anti-vibration devices 12. As a result, a sectional shape of the vertical frame member 25 is an open sectional shape (FIG. 19) that is open to the outside of the panel frame 22 at a position of the frame opening portion 27 and is a closed sectional shape at a position other than the frame opening portion 27 in the longitudinal direction of the vertical frame member 25.

The panel upper plate 23 is overlapped and bonded onto the upper surface of each of the vertical frame members 25 in the longitudinal direction of the vertical frame members 25, whereas the panel lower plate 24 is overlapped and bonded onto the lower surface of each of the vertical frame members 25 in the longitudinal direction of the vertical frame members 25. In this example, the panel lower-plate cutout portions 28 are not formed in the panel lower plate 24.

Each of the anti-vibration devices 12, which receives the vertical frame member 25, includes the flat spring 64 similar to that of the seventh embodiment. The flat spring 64 includes the curved plate portion 64*b* arranged outside of the panel frame 22 and receives the vertical frame member 25 in a state in which one of the opposed plate portions 64*a* is inserted into the vertical frame member 25 through the frame opening portion 27 and another of the opposed plate portions 64*a* is arranged below the car-platform panel 11. The upper surface of the one of the opposed plate portions 64*a* that is inserted into the vertical frame member 25 serves as the upper surface of the anti-vibration device 12. As a result, the upper surfaces of the anti-vibration devices 12 are arranged at a height position between the upper surface and the lower surface of the car-platform panel 11 in the vertical direction. Vibration from the car-platform support frame 13 to the car-platform panel 11 is suppressed by elastic deformation of the flat spring 64. The remaining configuration is the same as that of the first embodiment.

As described above, the frame opening portion 27 is formed on the side surface of both the side surfaces of each of the vertical frame members 25, which is located away from the panel main body 21. The anti-vibration devices 12 receive the vertical frame members 25 in a state in which the anti-vibration devices 12 are inserted into the vertical frame members 25 through the frame opening portions 27. Therefore, the work of mounting the anti-vibration devices 12 to the panel frame 22 can be performed outside of the car-platform member 11. Thus, the installation work for the car-platform device 7 can be facilitated.

Further, each of the anti-vibration devices 12 includes the flat spring 64 having the U-like shape. Therefore, the upper portions of the anti-vibration devices 12 can be inserted into the vertical frame members 25 from the side of the vertical frame members 25 through the frame opening portions 27 while avoiding walls of the vertical frame members 25.

Figure 20:
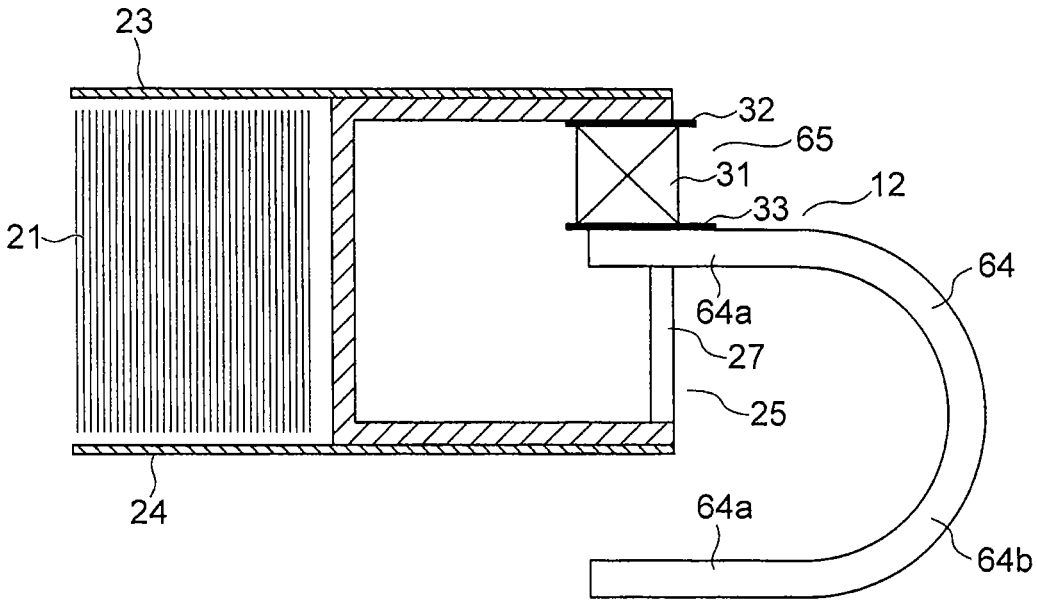
FIG. 20 is a sectional view for illustrating another example of the main part of the car-platform device according to the eighth embodiment of the present invention.

In the example described above, the anti-vibration device 12 includes the flat spring 64 alone. However, the anti-vibration device 12 may also include the rubber vibration isolator 65 similar to that of the first embodiment including the rubber elastic member 31, the anti-vibration upper plate 32, and the anti-vibration lower plate 33 in addition to the flat spring 64. In this case, as illustrated in FIG. 20, the rubber vibration isolator 65 is placed on the flat spring 64 so that the rubber vibration isolator 65 is arranged between the upper surface of the internal space of each of the vertical frame members 25 and the upper surface of the flat spring 64. As a result, the anti-vibration device 12 receives the vertical frame member 25 by the upper surface of the rubber vibration isolator 65.

Further, although the spacer 34 is interposed between the upper surface of each of the anti-vibration devices 12 and the panel frame 22 in the first and second embodiments, the spacer may be interposed between the lower surface of each of the anti-vibration devices 12 and the support surface of the car-platform support frame 13. Further, when the car-platform device clearance dimension d of the car-platform panel 11 falls within an appropriate range, the spacer 34 may be omitted.

Further, although the spacer 34 is not interposed between the upper surface of each of the anti-vibration devices 12 and the frame structure in the third to eighth embodiments, the spacer 34 may be interposed between the upper surface of each of the anti-vibration devices 12 and the frame structure. Further, the spacer 34 may be interposed between the lower surface of each of the anti-vibration devices 12 and the support surface of the car-platform support frame 13.

Further, the anti-vibration device 12 illustrated in FIG. 18 or FIG. 20, which includes a combination of the flat spring 64 and the rubber vibration isolator 65, may be applied to the car-platform device 7 of the first to sixth embodiments.

The invention claimed is:

1. An elevator car, comprising:

a car-platform panel comprising:

a panel main body;

a frame structure comprising a panel frame surrounding an outer peripheral portion of the panel main body; and a panel upper plate and a panel lower plate for individually covering an upper surface and a lower surface of the panel main body and an upper surface and a lower surface of the panel frame;

an anti-vibration device for receiving the frame structure by an upper surface thereof; and a car-platform support frame for supporting the car-platform panel through an intermediation of the anti-vibration device, the upper surface of the anti-vibration device being arranged at a height position between an upper surface and a lower surface of the car-platform panel in a vertical direction at least one of a plurality of frame members forming the panel frame is a frame member, and the frame member comprises a hollow member having a rectangular cross-section; the hollow member has a frame opening portion formed in any one of a lower surface and a side surface thereof; and the anti-vibration device receives the frame member in a state in which the anti-vibration device is inserted into the hollow member through the frame opening portion, wherein an inner surface of the hollow member is supported by the upper surface of the anti-vibration device.

* * * * *